US010238919B1

(12) United States Patent
Donovan et al.

(10) Patent No.: US 10,238,919 B1
(45) Date of Patent: Mar. 26, 2019

(54) CHEMILUMINESCENT SWIM FINS

(71) Applicants: Clare Donovan, River Ridge, LA (US); Flo Donovan, River Ridge, LA (US)

(72) Inventors: Clare Donovan, River Ridge, LA (US); Flo Donovan, River Ridge, LA (US)

( * ) Notice: Subject to any disclaimer, the term of this patent is extended or adjusted under 35 U.S.C. 154(b) by 0 days.

(21) Appl. No.: 15/892,076

(22) Filed: Feb. 8, 2018

(51) Int. Cl.
*A63B 31/11* (2006.01)

(52) U.S. Cl.
CPC ..... *A63B 31/11* (2013.01); *A63B 2207/00* (2013.01); *A63B 2208/03* (2013.01); *A63B 2209/00* (2013.01)

(58) Field of Classification Search
CPC .. A63B 31/11; A63B 2207/00; A63B 2208/03
See application file for complete search history.

(56) References Cited

U.S. PATENT DOCUMENTS

| | | | | |
|---|---|---|---|---|
| 5,511,999 | A * | 4/1996 | Cochran | A63B 31/11 441/64 |
| 7,828,615 | B2 * | 11/2010 | Bonis | A63B 31/11 441/61 |
| 8,870,616 | B2 * | 10/2014 | McKinney | B63C 9/20 362/108 |
| 8,882,554 | B2 * | 11/2014 | McKinney | B63B 35/7936 362/477 |
| 9,868,030 | B2 * | 1/2018 | Donovan | A63B 33/002 |
| 2013/0165003 | A1 * | 6/2013 | McKinney | B63B 35/7926 441/74 |
| 2015/0306460 | A1 * | 10/2015 | Donovan | A63B 33/002 2/442 |

* cited by examiner

*Primary Examiner* — S. Joseph Morano
*Assistant Examiner* — Jovon E Hayes
(74) *Attorney, Agent, or Firm* — Zachary R. Christiansen

(57) ABSTRACT

This invention is chemiluminescent swim fin system which allows one to swim at night or be worn at parties. It can be seen from behind has a large surface area for fin visibility. Its chemical composition allows it to be rapidly be recharged by lights, and exhibit bright visible light from a distance, but also allows for structural integrity of the material when used by swimmers.

9 Claims, 3 Drawing Sheets

CHEMILUMINESCENT SWIM FINS

CROSS REFERENCE TO RELATED APPLICATIONS

Not applicable.

REFERENCE TO GOVERNMENT FUNDING SOURCES

Not applicable.

REFERENCE TO SEQUENCE LISTING

Not applicable.

FIELDS OF THE INVENTION

The disclosure as detailed herein is in the technical field of sports equipment: More particularly, the present invention is in the technical field of swim fins.

DESCRIPTION OF RELATED ART

People have been using glow in the dark products (chemiluminescent) for many decades and subset of these uses are for swimming products. There are several reasons that chemiluminescent sportswear exist. The first is novelty. Chemiluminescent novelty items allow a group of gathering of people to have fun when navigating in a dark space where the glowing features of the apparel is the only thing that is seen. For example there are wind goggles that are made for a dog for riding in a sidecar or convertible referred to below as the dog wind goggles. It has phosphorescent materials for fluorescence in the frame region, but has holes in the side, has a non-lit band and could not be used for swimming without accommodating structural changes. Similarly, chemiluminescent and luminescent objects also exist for location and safety, such that when the lights go out, things can be found or located in the dark. For example, there are circular phosphorescent goggles with dark tinted lenses for welding, with a chemiluminescent ring around one portion of the frame for each eye. The welding glasses are useful both as a safety feature and for location, however, they are not for swimming or locating swimmers nor could perform these functions due to structural differences.

Night swimming is common for youths but visibility is an important factor in swimming safety. For example, several states have different regulations for supervision based on line of sight or pool area. Texas regulations state that:

(1) A post-10/01/99 pool that has a diving board(s) shall have at least one elevated lifeguard chair, located to provide a clear unobstructed view of the pool bottom in the diving area and shall comply with the following.
   (A) The seat of the lifeguard chair in the diving water area shall be located at an elevation at least 4 feet above the pool deck. The lifeguard chair may be portable so that its location can be optimized to prevent glare and provide proper supervision.
   (B) If the width of the pool is 45 feet or more, an additional elevated chair or station shall be provided and shall be located in the diving area on the opposite side of the pool.
   (C) Such lifeguard platforms or chairs shall be placed in locations to reduce sun glare on the water, and in positions which allow complete visual coverage of the pool and the pool bottom within a field of view no greater than 90 degrees on either side of a line of sight extending straight out from the platform or chair.

In addition, New York state regulations are:

"when pools exceed 3,400 square feet of pool surface area at least one additional aquatic supervisory staff shall be provided when the number of bathers exceeds or is likely to exceed 50 percent of the pool bather capacity, based on 25 square feet of pool surface area per bather."

Further, Oregon regulations state:

"(2) There shall be one lifeguard chair or elevated lifeguard platform for each 120 feet (36.6 m) of pool perimeter and with the exception of (3) of this section may be spaced at the discretion of the pool operator.

(3) Where more than one lifeguard chair or elevated lifeguard platform is required, there shall be one chair or platform located on each side of the pool."

GENERAL SUMMARY OF THE INVENTION

This invention is a combination swim fin and chemiluminescent body, which allows one to swim at night. It can be seen from behind, has a large surface area for visibility. It is an objective of the invention to have an unobstructed view of night-time phosphorescence of the swim fin. It is yet another objective of the invention to be able to easily locate a swimmer within a typical lifeguard range at night. It is yet another objective of the invention to be able to recharge the swim fins by holding them up to a pool light.

DETAILED DESCRIPTION

Figure 1:
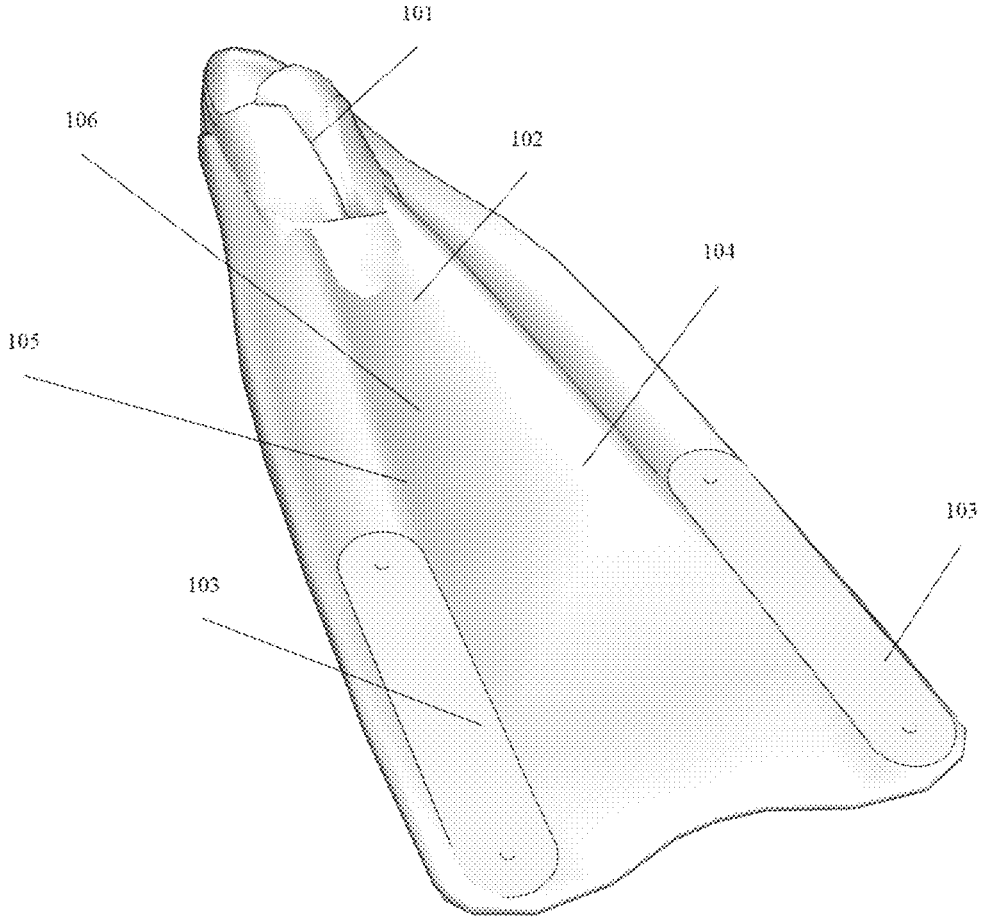
FIG. 1 is a perspective view, which shows top view of the swim fins.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural, logical, software, electrical and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an embodiment with several components in communication with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art. Referring now to FIG. 1, which shows top view of the swim fins.

Heel placement region 101 comprises the place where the individual puts one's heel in the swim fin 106. Heel placement region 101 interacts with multiple items: First, heel placement region 101 interacts with top foot region 302. Next, it interacts with foot placement region 301. Finally, it interacts with bottom of swim fin region 201. Heel placement region 101 is attached to foot placement region 301 and bottom of swim fin region 201. Spatially, heel placement region 101 is preferably positioned at the back of the swim fin 106. In some embodiments, it is thought that an example of heel placement region 101 may include heel strap and the like. If heel placement region 101 is absent, it is thought that that there are alternatives. For example, if absent then the heel will come out of the swim fin 106. Further, It is possible that in its absence then the user can not properly kick in the swim fin 106. Finally, if absent then no support for the heel. Heel placement region 101 has an alternative embodiment herein termed heel strap.

Toe opening region 102 comprises an opening near the toe to mimic barefoot conditions. Toe opening region 102 interacts with multiple entities: It interacts with foot placement region 301 and it also interacts with top foot region 302. Toe opening region 102 is attached to top foot region 302 and foot placement region 301. Spatially, toe opening region 102 is preferably positioned at the bottom of the foot placement region 301 towards the flipper blade region. Toe opening region 102 is preferably shaped like oval. In some embodiments, toe opening region 102 has a preferred length of 1 to 20 inches but in some embodiments, may range from a minimum of 0.5 inches to a maximum length of 40 inches. In some embodiments, the length of toe opening region 102 can be calculated by the length of the users toes. In some embodiments, it is thought that if toe opening region 102 is absent then barefoot feeling can not be mimicked. In other instances, if toe opening region 102 is absent then the toes become confined. One goal of toe opening region 102 is to prevent the toes from being restricted during use of the swim fin 106.

Reflector 103 comprises reflects light from a source back to the eye of the beholder. Reflector 103 is attached to swim fin 106 and flipper blade region. Reflector 103 is mainly thought to be composed of soft vinyl however, it is thought that in alternate embodiments that the thing may also be composed of hard plastic. In some embodiments, it is thought that if reflector 103 is absent then Then the fins do not have a light relecting part that reflects light back to the viewer. One goal of reflector 103 is to reflects light from a source back to the eye of the beholder.

Substrate silicone 104 is mainly thought to be composed of silicone, however other embodiments may be composed of any of the following: thermoplastic elastomers, styrenic block copolymers (TPE-s), polyolefin blends (TPE-o), elastomeric alloys (TPE-v or TPV), thermoplastic polyurethanes (TPU), thermoplastic copolyester, or thermoplastic polyamides. In some embodiments, substrate silicone 104 has a preferred volume of 70% by weight relative to the phosphorescent molecules 105 but in some embodiments, may range from a minimum of 40% by weight relative to the phosphorescent molecules 105 to a maximum volume of 75% by weight relative to the phosphorescent molecules 105. One goal of substrate silicone 104 is to structurally hold the integrity of the required flexing demands of the swim fins.

Phosphorescent molecules 105 is mainly thought to be composed of alkaline earth metal aluminate such as strontium aluminate activated with europium, silica aluminate, however other embodiments may be composed of any of the following: magnesium, calcium, or barium. In some embodiments, phosphorescent molecules 105 has a preferred volume of 35% by weight relative to the substrate silicone 104 but in some embodiments, may range from a minimum of 30% by weight relative to the substrate silicone 104 to a maximum volume of 40% by weight relative to the substrate silicone 104. In some embodiments, it is thought that if phosphorescent molecules 105 is absent then the swim fins do not have phosphorescent properties. One goal of phosphorescent molecules 105 is to server a brightness function. Swim fin 106 comprises accessories worn on the foot or leg and made from rubber, plastic or combinations of these materials, to aid movement through the water in water sports activities such as swimming, bodyboarding, bodysurfing, kneeboarding, riverboarding, underwater hockey, underwater rugby and various other types of underwater diving.

Swim fin 106 preferably comprises heel placement region 101, toe opening region 102, flipper blade region, top foot region 302, foot placement region 301, and finally bottom of swim fin region 201.

Figure 2:
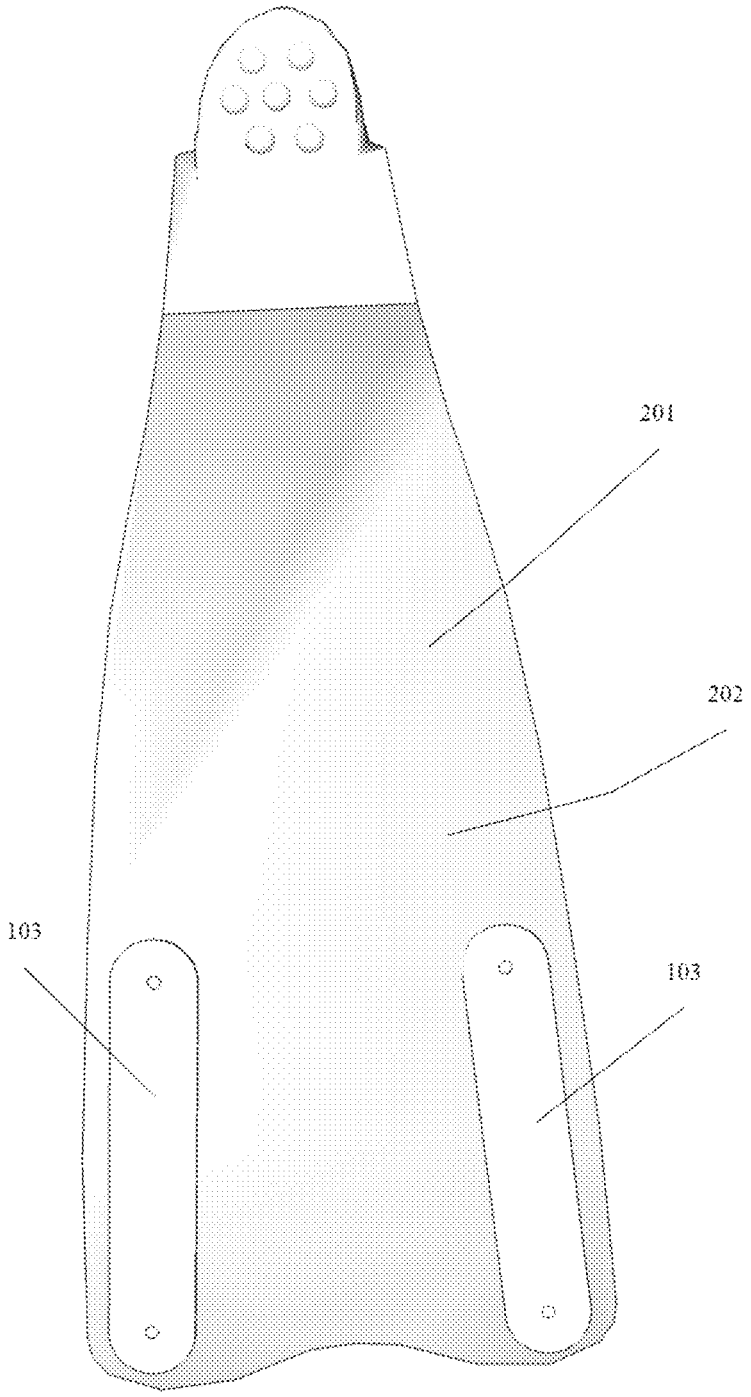
FIG. 2 is a perspective view, which shows bottom view of the swim fins.
Figure 3:
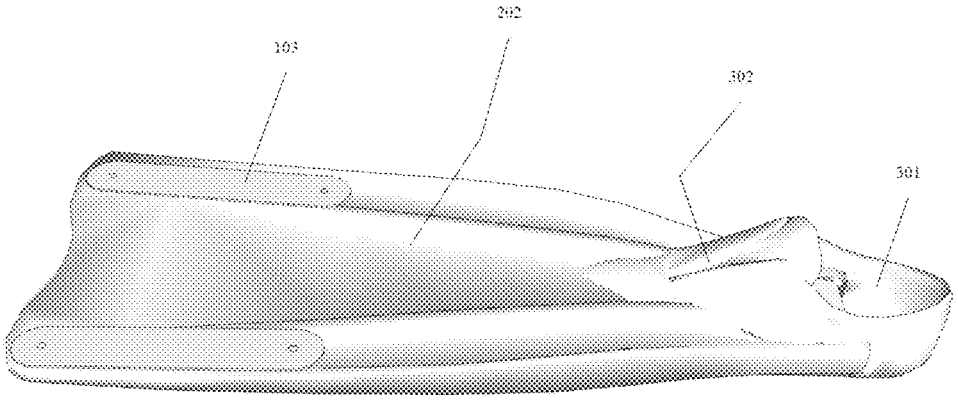
FIG. 3 is a perspective view, which shows a perspective view of the side of the fins.

Referring now to FIG. 2, which shows bottom view of the swim fins.

Bottom of swim fin region 201 comprises the bottom of the swim fin. Bottom of swim fin region 201 interacts with multiple items: First, bottom of swim fin region 201 interacts with toe opening region 102. Next, it interacts with foot placement region 301. Next, it interacts with flipper blade region. Finally, it interacts with monofin. Bottom of swim fin region 201 is attached to heel placement region 101 and flipper blade region. Spatially, bottom of swim fin region 201 is preferably positioned bottom of the swim fin 106. In some embodiments, bottom of swim fin region 201 has a preferred length of 0.5 to 35 inches but in some embodiments, may range from a minimum of 0.5 inches to a maximum length of 85 inches. In some embodiments, the length of bottom of swim fin region 201 can be calculated by size of the users foot with the size of the chosen blade. In some embodiments, it is thought that if bottom of swim fin region 201 is absent then the user can not use the swim fin 106.

Chemiluminescent silicone 202 comprises polymers that include any inert, synthetic compound made up of repeating units of siloxane, which is a chain of alternating silicon atoms and oxygen atoms, frequently combined with carbon and/or hydrogen. polysiloxanes is an acronym which stands for chemiluminescent silicone 202. Chemiluminescent silicone 202 interacts with chemiluminescent forumla and water-based sealant. Chemiluminescent silicone 202 is attached to the chemiluminescence mixture. In some embodiments, chemiluminescent silicone 202 has a preferred length of 1.5 to 35 inches but in some embodiments, may range from a minimum of 1 inches to a maximum length of 45 inches. In some embodiments, the length of chemiluminescent silicone 202 can be calculated by the size of the indivduals foot. In some embodiments, it is thought that an example of chemiluminescent silicone 202 could be combined with rubber or perhaps combined with plastic and the like. In some embodiments, it is thought that if chemiluminescent silicone 202 is absent then the swim fin will will not work. The swin fin can not be replaced with another material. One goal of chemiluminescent silicone 202 is to is to create resistance against the water. Chemiluminescent silicone 202 comprises phosphorescent molecules 105 and substrate silicone 104.

The following elements and/or terms computer aided design, flipper blade region, heel strap, monofin and chemiluminescent are important for the working functionality, but do not appear in the drawings and are shown below.

Heel strap comprises keeps the heel in the swim fin.

Monofin comprises a version of the flipper blade region in which there is only one fin present.

Chemiluminescent comprises the emission of light (luminescence), as the result of a chemical reaction.

What is claimed is:

1. A swim fin comprising:
a. A bottom of swim fin region;
b. A foot placement region;
c. A heel placement region;
d. A toe opening region;
e. A top foot region; and
f. A flipper blade region wherein the flipper blade region further comprises
  i. A reflector; and
  ii. A chemiluminescent silicone.

2. The apparatus of claim 1 wherein the chemiluminescent silicone further comprises:
a. A substrate silicone;
b. phosphorescent molecules.

3. The apparatus of claim 2 wherein the phosphorescent molecules have a concentration of 30% to 40% by weight relative to the substrate silicone.

4. The apparatus of claim 2 wherein the substrate silicone is 40% by weight relative to the phosphorescent molecules to a maximum of 75% by weight relative to the phosphorescent molecules.

5. The apparatus of claim 2 wherein the phosphorescent molecules have a concentration of 25% to 60% by weight relative to the substrate silicone.

6. A swim fin comprising:
a. A bottom of swim fin region;
b. A foot placement region;
c. A heel placement region;
d. A top foot region; and
e. A flipper blade region wherein the flipper blade region further comprises chemiluminescent silicone.

7. The apparatus of claim 6 wherein the flipper blade region further comprises a reflector.

8. The apparatus of claim 6 wherein the swim further comprises a toe opening region.

9. The apparatus of claim 6 wherein the substrate silicone is 40% by weight relative to the phosphorescent molecules to a maximum of 75% by weight relative to the phosphorescent molecules.

* * * * *